US008966720B2

(12) United States Patent
Miyazaki et al.

(10) Patent No.: US 8,966,720 B2
(45) Date of Patent: Mar. 3, 2015

(54) SLIDER FOR SLIDE FASTENER

(75) Inventors: Yohei Miyazaki, Toyama (JP); Keiichi Keyaki, Toyama (JP)

(73) Assignee: YKK Corporation (JP)

( * ) Notice: Subject to any disclaimer, the term of this patent is extended or adjusted under 35 U.S.C. 154(b) by 220 days.

(21) Appl. No.: 13/502,782

(22) PCT Filed: Dec. 24, 2010

(86) PCT No.: PCT/JP2010/073420

§ 371 (c)(1),
(2), (4) Date: Apr. 19, 2012

(87) PCT Pub. No.: WO2011/078358

PCT Pub. Date: Jun. 30, 2011

(65) Prior Publication Data

US 2012/0204384 A1 Aug. 16, 2012

(30) Foreign Application Priority Data

Dec. 25, 2009 (JP) ..... 2009/071664

(51) Int. Cl.
*A44B 19/26* (2006.01)
*A44B 19/30* (2006.01)

(52) U.S. Cl.
CPC ..... *A44B 19/26* (2013.01); *A44B 19/305* (2013.01)
USPC ..... 24/429; 24/415

(58) Field of Classification Search
CPC .... A44B 19/24; A44B 19/262; A44B 19/303; A44B 19/305; A44B 19/306; A44B 19/308; A44B 19/265
USPC ..... 24/420–431
See application file for complete search history.

(56) References Cited

U.S. PATENT DOCUMENTS

| | | | | |
|---|---|---|---|---|
| 4,102,022 | A * | 7/1978 | Aoki | 24/424 |
| 4,395,891 | A | 8/1983 | Remington | |
| 4,982,479 | A | 1/1991 | Oda | |
| 5,568,674 | A | 10/1996 | Harada et al. | |
| 5,625,928 | A | 5/1997 | Terada et al. | |
| 5,901,420 | A * | 5/1999 | Oda | 24/420 |

(Continued)

FOREIGN PATENT DOCUMENTS

| | | | |
|---|---|---|---|
| CN | 119510 | A | 4/1996 |
| CN | 1133151 | A | 10/1996 |

(Continued)

OTHER PUBLICATIONS

International Search Report and Written Opinion, PCT International Application No. PCT/JP2010/073420, mailed Apr. 5, 2011.

*Primary Examiner* — Jack W Lavinder
(74) *Attorney, Agent, or Firm* — Kilpatrick Townsend & Stockton LLP

(57) ABSTRACT

A slider of the invention has a slider body and a tab, and first and second tab attachment posts of the slider body rotatably retain an attachment shaft portion of the tab. Further, a cover body covering at least the first and second tab attachment posts is fixed to an upper blade of the slider body. In accordance with this, since the slider has a good touch feeling and an improved outer appearance, it is possible to construct a slide fastener which is excellent in quality. Further, in the case that the slider has a stop mechanism, the stop mechanism can be protected by the cover body, and it is accordingly possible to prevent a trouble in the stop mechanism.

9 Claims, 8 Drawing Sheets

(56) References Cited

U.S. PATENT DOCUMENTS

| | | | | |
|---|---|---|---|---|
| 7,257,868 | B2 * | 8/2007 | Yoneshima | 24/415 |
| 2003/0182774 | A1 | 10/2003 | Lin | |

FOREIGN PATENT DOCUMENTS

| | | | |
|---|---|---|---|
| CN | 1182561 | A | 5/1998 |
| EP | 383207 | A1 | 8/1990 |
| EP | 683992 | A2 | 11/1995 |
| EP | 839466 | A1 | 5/1998 |
| GB | 2085071 | A | 4/1982 |
| GB | 2295646 | A | 6/1996 |
| JP | 57-89802 | A | 6/1982 |
| JP | 63-001854 | Y2 | 1/1988 |
| JP | 2-213302 | A | 8/1990 |
| JP | 7-313215 | B | 12/1995 |
| JP | 8-10015 | A | 1/1996 |
| JP | 8-150003 | A | 6/1996 |
| JP | 10-127312 | A | 5/1998 |
| JP | 3087434 | U | 5/2002 |
| KR | 10-1992-0001864 | B | 3/1992 |
| KR | 10-0137796 | B | 5/1998 |
| KR | 10-0152166 | B | 10/1998 |
| KR | 10-0243728 | B | 3/2002 |
| WO | 2010070744 | A1 | 6/2010 |

* cited by examiner

SLIDER FOR SLIDE FASTENER

This application is a national stage application of PCT/JP2010/073420 which claims priority to PCT/US2009/071664, both of which are incorporated herein by reference.

TECHNICAL FIELD

The invention relates to a slider which is used in a slide fastener, and more particularly to a slider having a locking pawl and provided with a stop mechanism which can retain a stop state with respect to an element row of the slider fastener.

BACKGROUND ART

Conventionally, the slide fastener has been used in various products such as clothes, bags or the like and various functions are demanded in accordance with the product using the slide fastener. For example, with regard to a slider which is one of constructing parts of the slide fastener, there has been a case that it is demanded a function (a stop mechanism) of retaining the slider at a stop position of the element row at a time of stopping a sliding motion with respect to the element row of the slide fastener.

One example of the slider provided with the stop mechanism mentioned above is disclosed, for example, in Japanese Utility Model Application Publication No. 63-1854 (Patent Document 1), WO 2010/070744 (Patent Document 2) and the like. The sliders of the Patent Document 1 and the Patent Document 2 are provided with a stop mechanism by an installation of a leaf spring member having a locking pawl to a slider body.

Specifically describing, the sliders described in the Patent Document 1 and the Patent Document 2 have a slider body, a tab which is rotatably retained in the slider body, and a leaf spring member which is installed to the slider body.

The slider body has upper and lower blades, a connecting post which connects between one end portions of the upper and lower blades, and flanges which are arranged in right and left side portions of the upper and lower blades. Further, the slider body has shoulder ports which are arranged in right and left both sides of the connecting post, and a rear port which is arranged in another end, and a Y-shaped element guide path connecting the right and left shoulder ports and the rear port is formed between the upper and lower blades.

Further, the upper blade of the slider body has right and left tab attachment posts which rotatably retain one end of the tab, and an insertion groove which is arranged in a center portion in a horizontal direction of the upper blade, and inserts the leaf spring member.

The tab retaining portion of the upper blade has a pair of front and rear post portions which are provided in a protruding manner in right and left both sides of the insertion groove, and an attachment shaft portion mentioned below of the tab is rotatably retained to the tab attachment post by caulking the front and rear posts in such a direction as to move close to each other, after the attachment shaft portion of the tab is inserted between the front and rear post portions.

The insertion groove of the upper blade has a groove width which is equal to or more than a width of the leaf spring member, and is formed in such a manner that the leaf spring member can be stably inserted. Further, in a rear end portion of the insertion groove is pierced a pawl hole which can insert a locking pawl mentioned below of the leaf spring member at a time when the leaf spring member is arranged within the insertion groove.

The tab has a tab main body portion, right and left arm portions which are extended in parallel from one end of the tab main body portion, an attachment shaft portion which connects apical portions of the right and left arm portions, and the attachment shaft portion of the tab is provided with a cam portion which has a cam shaped cross section. For example, in the case of the Patent Document 1, the cam portion is provided by forming a cross section of the attachment shaft portion in a shape obtained by cutting a partial circular arc from a circular form, and in the case of the Patent Document 2, the cam portion is provided by protruding a projection portion to the tab main body portion side from the center portion of the attachment shaft portion.

The leaf spring member is provided with elasticity, and is installed to the slider body in such a manner as to cover the attachment shaft portion of the tab and the cam portion from the above. Further, a locking pawl which can move into and out of the element guide path via a pawl hole of the slider body is arranged in one end portion of the leaf spring member.

In the case of assembling the slider which is constructed by the slider body, the tab and the leaf spring member as mentioned above, first of all, the attachment shaft portion of the tab is assembled in the right and left tab attachment posts which are arranged in the slider body. Specifically, the front and rear post portions are inflected in such a direction of moving close to each other so as to be caulked, in a state in which the attachment shaft portion of the tab is inserted between the front and rear post portions in the tab attachment post. In accordance with this, the tab is retained so as to be rotatable around the attachment shaft portion with respect to the slider body.

At this time, the tab prevents a position of the tab from being deviated in a slider width direction from the slider body by making a difference of a distance between the right and left arm portions arranged in the tab, and a distance between outer side surfaces of the right and left tab attachment posts arranged in the slider body small, and the cam portion of the tab is aligned with an appropriate position.

Subsequently, the leaf spring member is assembled in the slider body which retains the tab. In this case, the leaf spring member is installed to the slider body in such a manner as to cover the attachment shaft portion of the tab and the cam portion from the above in the leaf spring member, and insert the locking pawl of the leaf spring member to the pawl hole of the slider body. In accordance with this, the slider is assembled.

The slider assembled as mentioned above is structured such that the locking pawl of the leaf spring member protrudes into the element guide path via the pawl hole of the slider body, for example, in the case that the tab is tilted to the rear port side. In accordance with this, since the locking pawl is engaged with the element row of the slide fastener, the slider is prevented from sliding along the element row, and the stop state of the slider is retained.

On the other hand, since the leaf spring member is lifted up by the cam portion which is provided in the attachment shaft portion of the tab at a time when the tab is raised up with respect to the slider body, or is brought down to the front end side of the slider, the locking pawl of the leaf spring member gets out of (evacuates from) the element guide path. In accordance with this, the state in which the locking pawl is engaged with the element row is cancelled, and it is possible to smoothly slide the slider along the element row.

Further, in the sliders described in the Patent Document 1 and the Patent Document 2, as mentioned above, the attachment shaft portion of the tab is retained to the tab attachment posts by caulking the right and left tab attachment posts arranged in the slider body. In accordance with this, it is possible to firmly fix the attachment shaft portion of the tab to a predetermined position of the slider body.

Accordingly, the tab is hard to be detached from the slider body, and it is possible to securely construct the stop mechanism of the slider so as to smoothly function. Further, since the stop mechanism in the sliders described in the Patent Document 1 and the Patent Document 2 can be structured such as to be lower than a rising height of the tab attaching post after the caulking process, there can be obtained such an effect that can make a thickness of a whole of the slider thin.

PRIOR ART DOCUMENT

Patent Document

Patent Document 1: Japanese Utility Model Application Publication No. 63-1854

Patent Document 2: WO 2010/070744

SUMMARY OF THE INVENTION

Problems to be Solved by the Invention

In the slider provided with the stop mechanism described in the Patent Document 1 and the Patent Document 2 as mentioned above, since the right and left tab attachment posts are exposed to the outer portion, and the leaf spring member having the locking pawl is installed to the slider body in such a manner as to cover the attachment shaft portion of the tab and the cam portion from the above, the leaf spring member is also exposed to the outer portion of the slider.

In the slider used in the slide fastener, there has been such a problem that if the tab attachment post and the leaf spring member are exposed so as to be visible from the outer portion, an outer appearance quality of the slider, and an outer appearance quality of the slide fastener are lowered, and a touch feeling is deteriorated.

Further, in the case that the leaf spring member is exposed to the outer portion, there is a high possibility that the leaf spring member experiences a shock or the like from the outer portion. In this case, when the leaf spring member experiences a shock or the like from the outer portion, a deformation or a breakage of the leaf spring member tends to be generated, and there has been such a problem that a trouble of the stop mechanism of the slider is caused.

On the other hand, in the sliders of the Patent Document 1 and the Patent Document 2, since the difference of the distance between the right and left arm portions arranged in the tab, and the distance between the outer side surfaces of the right and left tab attachment posts arranged in the slider body is small as mentioned above, the position of the tab is hard to be largely deviated in the slider width direction with respect to the slider body.

However, in this case, a positioning means of the tab with respect to the slider body utilizes the distance between the right and left arm portions in the tab, and the distance between the outer side surfaces of the right and left tab attachment posts in the slider body. In accordance with this, a size and a positional relationship in the right and left arm portions of the tab and the tab attachment post of the slider body which are directly visible from the outer portion are necessarily determined, and there has been such a defect that a design freedom and a width of design in the slider are limited.

The invention is made by taking the conventional problems mentioned above into consideration, and a particular object of the invention is to provide a slider for a slide fastener which prevents an outer appearance quality and a touch feeling of the slider and the slide fastener from being lowered, and protects a stop mechanism from a shock from an outer portion so as to make the stop mechanism hard to be broken down, and to provide a slider for a slide fastener which can smoothly assemble the slider by positioning a tab with respect to a slider body in a portion which is invisible from the outer portion.

Means for Solving the Problems

In order to achieve the object mentioned above, a slider for a slide fastener provided by the invention is a slider for a slide fastener having a slider body in which upper and lower blades are connected by a guide column, and first and second tab attachment posts are provided in a rising manner in an upper surface of the upper blade, and a tab in which a tab main body and an attachment shaft portion are connected by a pair of arm portions, as a basic structure, and the first and second tab attachment posts being caulked in a state in which the attachment shaft portion of the tab is inserted so as to rotatably retain the attachment shaft portion, mainly characterized in that a cover body covering at least the first and second tab attachment posts is fixed to the upper blade.

Particularly, in the slider for the slide fastener in accordance with the invention, it is preferable that a pawl hole is arranged between the first and second tab attachment posts of the upper blade, a stop mechanism is constructed by a locking pawl which is arranged so as to be movable into and out of an element guide path between the upper and lower blades, via the pawl hole on the basis of an operation of the tab, and the stop mechanism is covered by the cover body which is fixed to the upper blade.

Further, in the slider for the slide fastener in accordance with the invention, it is preferable that a movement control portion is arranged in the attachment shaft portion, the movement control portion controlling a movement of the tab in an axial direction of the attachment shaft portion with respect to the first and second tab attachment posts, and securing a gap capable of accommodating a side wall portion of the cover body, between outer side surfaces of the first and second tab attachment posts and the arm portion of the tab.

Particularly, it is preferable that the movement control portion protrudes in a direction which is orthogonal to an axial direction of the attachment shaft portion from the attachment shaft portion.

In this case, it is preferable that the movement control portion is arranged between the first and second tab attachment posts. Particularly, it is preferable that a dimension of the movement control portion in the axial direction of the attachment shaft portion is set to be equal to or more than 80% of a distance between the first and second tab attachment posts.

Further, in the slider for the slide fastener in accordance with the invention, the movement control portion may be arranged one by one in an outer side of the first and second tab attachment posts.

In the invention, it is preferable that the locking pawl is arranged in a leaf spring member which is installed to the slider body, and the attachment shaft portion of the tab has a projection portion which pushes up the leaf spring member on the basis of an operation of the tab so as to move the locking pawl out of the element guide path.

Further, in the invention, the locking pawl may be formed so as to protrude out of the attachment shaft portion of the tab.

Effect of the Invention

The slider for the slide fastener in accordance with the invention has the slider body in which the first and second tab attachment posts are provided in a rising manner in the upper blade, the tab in which the attachment shaft portion is arranged, and the cover body, and the attachment shaft portion of the tab is rotatably retained to the first and second tab attachment posts of the slider body. Further, the cover body covers, at least, the first and second tab attachment posts arranged in the upper blade so as to be fixed to the upper blade.

In the slider in accordance with the invention having the structure mentioned above, since at least a part of the first and second tab attachment posts and the attachment shaft portion of the tab is covered by the cover body, a good touch feeling can be obtained. Further, in the slider, the first and second tab attachment posts are invisible from the outer portion by the cover body, an outer appearance is improved, and it is possible to construct a slide fastener which is excellent in a quality (particularly, an outer appearance quality), by using the slider.

Particularly, in the slider for the slide fastener in accordance with the invention, the pawl hole is arranged between the first and second tab attachment posts of the upper blade, and the stop mechanism is constructed by the locking pawl which is arranged so as to be movable into and out of the element guide path between the upper and lower blades, via the pawl hole on the basis of the operation of the tab. Further, the stop mechanism is covered by the cover body which is fixed to the upper blade.

In accordance with this, since not only the first and second tab attachment posts of the slider body but also the stop mechanism of the slider is covered by the cover body, a further good touch feeling can be obtained, and it is possible to further improve the outer appearance of the slider. Further, since the stop mechanism of the slider is covered by the cover body so as to be protected, it is possible to stably protect the stop mechanism from a shock or the like even if the slider experiences a shock or the like from the outer portion, whereby it is possible to prevent a trouble of the stop mechanism in the slider.

In the slider for the slide fastener in accordance with the invention mentioned above, the movement control portion is arranged in the attachment shaft portion of the tab, the movement control portion controlling the movement of the tab in the axial direction of the attachment shaft portion with respect to the first and second tab attachment posts, and securing the gap capable of accommodating the side wall portion of the cover body, between the outer side surfaces of the first and second tab attachment posts and the arm portion of the tab.

For example, at a time of assembling the cover body in the upper blade of the slider body so as to fix, after rotatably retaining the attachment shaft portion of the tab in the first and second tab attachment posts of the slider body, the cover body interferes with the tab if the gap capable of inserting the side wall portion of the cover body is not provided between the first tab attachment post and the arm portion of the tab, and between the second tab attachment post and the arm portion of the tab, and it is impossible to assemble the cover body in the upper blade of the slider body. In accordance with this, it is necessary to set a predetermined gap between the first tab attachment post and the arm portion of the tab, and between the second tab attachment post and the arm portion of the tab.

However, in the case that the gap as mentioned above is provided between the first tab attachment post and the arm portion of the tab, and between the second tab attachment post and the arm portion of the tab, the position of the tab tends to be deviated in an axial direction (a slider width direction) of the attachment shaft portion of the tab with respect to the slider body, on the basis of an existence of the gap. In this case, if the position of the tab is deviated in the slider width direction, the gap between the first tab attachment post and the arm portion of the tab, or the gap between the second tab attachment post and the arm portion of the tab becomes narrow, and there is generated such a problem that the cover body interferes with the tab at a time of assembling the cover body in the upper blade of the slider body.

In order to dissolve the problem mentioned above, in accordance with the invention, the movement control portion as mentioned above is arranged in the attachment shaft portion of the tab. In accordance with this, the positioning of the tab in the slider width direction can be easily carried out with respect to the first and second tab attachment post, at a time of retaining the attachment shaft portion of the tab in the first and second tab attachment posts of the slider body, and it is possible to prevent the position of the tab from being deviated in the slider width direction by controlling the movement of the tab in the axial direction of the attachment shaft portion.

In accordance with this, when the attachment shaft portion of the tab is retained in the first and second tab attachment posts, it is possible to absolutely secure an appropriate gap which can insert the side wall portion of the cover body, between the outer side surface of the first tab attachment post and the arm portion of the tab, and between the outer side surface of the second tab attachment post and the arm portion of the tab. Accordingly, it is possible to smoothly assemble the cover body in the upper blade so as to fix without the cover body interfering with the tab, at a time of assembling the cover body in the upper blade of the slider body.

Further, in the slider in accordance with the invention, since the movement control portion of the tab and the first and second tab attachment posts can be concealed in the inner portion of the cover body fixed to the upper blade in such a manner as to be directly invisible from the outer portion, it is possible to enlarge a design freedom and a width of a design in the slider.

In the slider in accordance with the invention, the movement control portion protrudes in the direction which is orthogonal to the axial direction of the attachment shaft portion from the attachment shaft portion. Particularly, the movement control portion is arranged between the first and second tab attachment posts. In accordance with this, since the tab is securely positioned with respect to the first and second tab attachment posts, and the movement control portion comes into contact with the first tab attachment post and/or the second tab attachment post at a time when the tab is retained in the first and second tab attachment post, it is possible to securely prevent the position of the tab from being deviated in the slider width direction. Further, if the movement control portion is arranged between the first and second tab attachment posts, it is possible to securely conceal the movement control portion in the inner portion of the cover body at a time of assembling the slider.

In this case, the dimension of the movement control portion in the axial direction of the attachment shaft portion is set to be equal to or more than 80% of the distance between the first and second tab attachment posts, and preferably equal to or more than 85%. In accordance with this, it is possible to more securely position the tab with respect to the first and second tab attachment posts. In this case, in the invention, the dimension in the axial direction of the attachment shaft portion of the movement control portion may be smaller than the distance between the first and second tab attachment posts (that is, less than 100% of the distance between the first and second tab attachment posts), however, taking into consideration a parts dimensional accuracy of the slider body and the tab, and an assembling easiness of the tab with respect to the slider body, it is preferable to be set to be equal to or less than 95% of the distance between the first and second tab attachment posts.

Further, in the slider for the slide fastener in accordance with the invention, the movement control portion may be arranged one by one in the outer side of the first and second tab attachment posts. In accordance with the provision of the movement control portion as mentioned above, it is also possible to securely position the tab with respect to the first and second tab attachment posts, and it is possible to securely prevent the position of the tab from being deviated in the slider width direction with respect to the slider body, after retaining the tab in the first and second tab attachment posts.

In the invention, the locking pawl constructing the stop mechanism is arranged in the leaf spring member which is installed to the slider body. Further, the attachment shaft portion of the tab has the projection portion which pushes up the leaf spring member on the basis of the operation of the tab so as to move the locking pawl out of the element guide path.

In accordance with the slider of the invention having the structure mentioned above, it is possible to easily construct the stably functioning stop mechanism within the cover body. In accordance with this, it is possible to securely protect the stop mechanism by the cover body, and it is possible to prevent the stop mechanism from being exposed to the outer portion.

In this case, an angle between a protruding direction of the movement control portion and a protruding direction of the projection portion is set to be larger than 90 degree, and is preferably set such that the protruding direction of the movement control portion and the protruding direction of the projection portion are inverted to each other (such that the angle between the protruding direction of the movement control portion and the protruding direction of the projection portion comes to 180 degree).

For example, in the case that the caulking process is carried out in the first and second tab attachment posts of the slider body as mentioned above, and the attachment shaft portion of the tab is rotatably retained in the first and second tab attachment posts, a space portion having such a size that the movement control portion of the tab is able to enter into may be formed between the apical portions of a pair of post portions in the first tab attachment post, and between the apical portions of a pair of post portions in the second tab attachment post.

In this case, if the tab moves in the slider width direction at a time when the position of the space portion mentioned above formed in the first and second tab attachment posts and the position of the movement control portion of the tab overlap, on the basis of the operation of the tab, there is a risk that the movement control portion of the tab enters into the space portion mentioned above, and the tab-catches on the first or second tab attachment post so as to be non-rotatable.

In order to dissolve the problem mentioned above, in accordance with the invention, the angle between the protruding direction of the movement control portion and the protruding direction of the projection portion is set to be larger than 90 degree as mentioned above. In accordance with this, since the movement control portion of the tab does not lap over the position of the space portion mentioned above formed in the first and second tab attachment posts, within a rotatable range of the tab which is retained in the first and second tab attachment posts of the slider body, it is possible to prevent the tab from becoming non-rotatable.

On the other hand, in the invention, the locking pawl constructing the stop mechanism may be formed so as to protrude out of the attachment shaft portion of the tab. Since the stably functioning stop mechanism can be easily constructed within the cover body even in the slider mentioned above, it is possible to securely protect the stop mechanism by the cover body, and it is possible to prevent the stop mechanism from being exposed to the outer portion.

In this case, it is preferable that the movement control portion protrudes in a direction which is in parallel to the arm portion. Since the movement control portion is arranged in the attachment shaft portion of the tab, it is possible to securely carry out the positioning of the tab. In addition, the movement control portion can serve as a stopper stopping the rotating motion of the tab at a time of coming into contact with the upper blade of the slider body, and a limit of rotating motion of the tab can be set by the movement control portion.

MODE FOR CARRYING OUT THE INVENTION

A description will be in detail given below of a preferable mode for carrying out the invention by listing up embodiments with reference to the accompanying drawings. In this case, the invention is not limited to the embodiments described below at all, but can be variously modified as long as it has substantially the same structure as the invention, and achieves the same operation and effect.

First Embodiment

Figure 1:
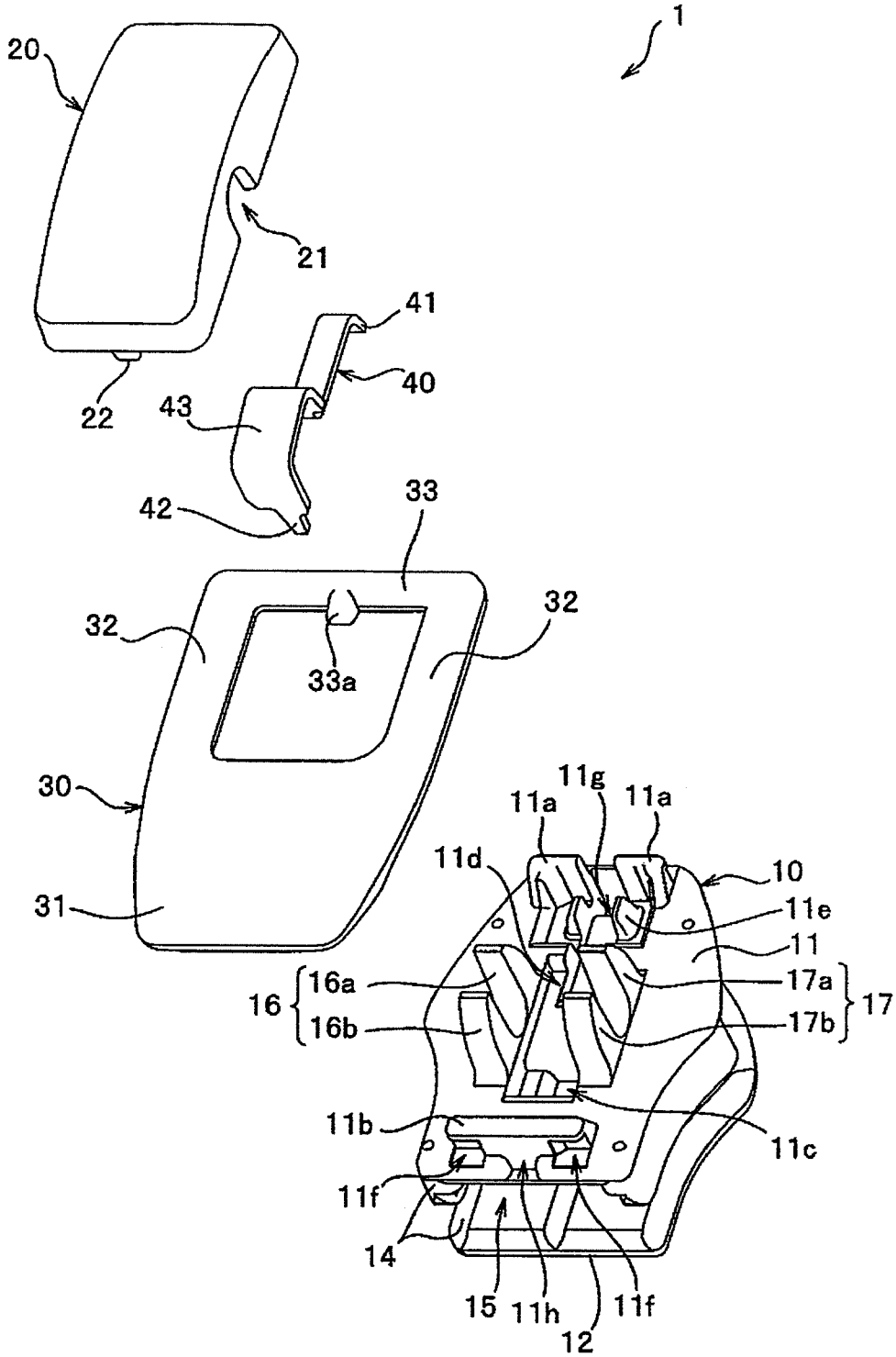
FIG. 1 is an exploded perspective view of a slider in accordance with a first embodiment of the invention.
Figure 2:
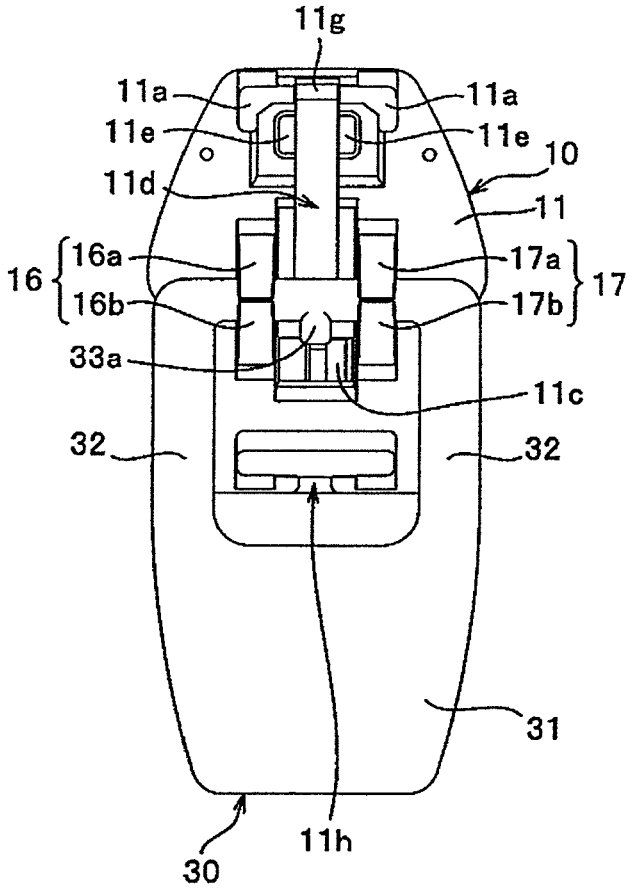
FIG. 2 is a top elevational view showing a state before a leaf spring member and a cover body are installed in the slider.

FIG. 1 is an exploded perspective view of a slider in accordance with a first embodiment, and FIG. 2 is a top elevational view showing a state before a leaf spring member and a cover body of the slider are installed.

In the following description, a back and forth direction of the slider means a direction which is in parallel to a sliding direction of the slider (a length direction of the slider), a direction for sliding at a time of coupling right and left element rows in a slide fastener is set to a forward direction, and a direction for sliding at a time of separating the right and left element rows is set to a rearward direction. Further, an up and down direction of the slider means a height direction of the slider, a direction in a side in which a tab is attached to a slider body is set to an upward direction, and a direction in an opposite side is set to a downward direction. Further, a right and left direction of the slider means a width direction of the slider.

A slider 1 for a slide fastener in accordance with the present first embodiment has a slider body 10, a cover body 20 which is fixed to the slider body 10, a tab 30 which is rotatably retained to the slider body 10, and a leaf spring member 40 which is provided in one end portion with a locking pawl 42.

In the slider 1, the slider body 10, the cover body 20 and the tab 30 are manufactured by die cast molding or press molding a metal material such as an aluminum alloy, a zinc alloy or the like. Further, the leaf spring member 40 is formed by punching a metal piece having a predetermined shape from a continuous long metal sheet material such as a stainless steel, and applying a bending process to the obtained metal piece.

The slider body 10 in the slider 1 has an upper blade 11, a lower blade 12 which is arranged in parallel so as to be away from the upper blade 11, a guide column which connects front end portions of the upper and lower blades 11 and 12, and flanges 14 which are arranged in right and left side edges of the upper and lower blades 11 and 12. Shoulder ports formed while holding the guide column between them are formed in a front end of the slider body 10, and a rear port is formed in a rear end of the slider body 10. Further, a Y-shaped element guide path 15 communicating the right and left shoulder ports and the rear port is formed between the upper and lower blades 11 and 12.

On an upper surface of the upper blade 11 in the slider body 10, there are provided with a forward fixing post 11*a* and a rearward fixing post 11*b* to which the cover body 20 is caulked and fixed, left and right first and second tab attachment posts 16 and 17 which are arranged approximately in a center portion in a slider length direction (a back and forth direction) in the upper blade 11, and retains an attachment shaft portion 33 mentioned below of the tab 30, an accommodating groove 11*d* which is arranged between the first and second tab attachment posts 16 and 17, and accommodates the leaf spring member 40, and a pair of right and left caulking portions 11*e* which are arranged in a front end portion of the upper blade 11 and caulk and fix the leaf spring member 40.

The forward fixing posts 11*a* are provided one by one in a rising manner right and left while holding the accommodating groove 11*d* between them in a front end portion of the upper blade 11. In a front face portion of the right and left forward fixing posts 11*a*, there is formed a fitting and attaching hole portion which is not illustrated and is provided for fitting and attaching a concave portion of the cover body 20 (a convex portion in an inner wall surface side) in accordance with a caulking process of the cover body 20, at a time of fixing the cover body 20.

The rearward fixing post 11*b* is provided in a rising manner in the center portion in the slider width direction. In a rear face portion of the rearward fixing post 11*b*, there is formed a fitting and attaching hole portion 11*f* for fitting and attaching the concave portion of the cover body 20 in accordance with a caulking at a time of caulking and fixing the cover body 20. Further, the right and left forward fixing posts 11*a* and the rearward fixing post 11*b* are structured such that when the cover body 20 is laid over the slider body 10 in such a manner as to cover the upper surface side of the upper blade 11, they can come into contact with the inner surfaces of the front and rear wall portions and the right and left side wall portions of the cover body 20 so as to position the cover body 20 in the back and forth direction and the right and left direction. Further, in a rear end portion of the upper blade 11, there is arranged a fitting concave portion 11*h* which makes a protruding portion 22 mentioned below of the cover body 20 fit into at a time of fixing the cover body 20 to the upper blade 11.

The first tab attachment post 16 in the left side and the second tab attachment post 17 in the right side are provided in a rising manner symmetrically while holding the accommodating groove 11*d* between them, and respectively have front post portions 16*a* and 17*a* and rear post portions 16*b* and 17*b*. The front post portions 16*a* and 17*a* and the rear post portions 16*b* and 17*b* are provided in a rising manner in such a manner that a cross sectional dimension in a back and forth direction is reduced gradually in accordance with an increase of a height (toward an upward direction), and a gap which can insert an attachment shaft portion 33 of the tab 30 is provided between the front post portions 16*a* and 17*a* and the rear post portions 16*b* and 17*b*.

The first and second tab attachment posts 16 and 17 in left and right sides as mentioned above can retain the attachment shaft portion 33 of the tab 30 rotatably at a predetermined position, by inserting the attachment shaft portion 33 of the tab 30 into the gap between the front post portions 16*a* and 17*a* and the rear post portions 16*b* and 17*b*, and thereafter pressing upper end portions of the front and rear post portions 16*a*, 16*b*, 17*a* and 17*b* in a direction in which they come close to each other so as to carry out a caulking process.

The accommodating groove 11*d* accommodating the leaf spring member 40 is arranged from a position at which the right and left forward fixing post 11*a* is arranged to a position which is rearward of the first and second tab attachment posts 16 and 17, in the center portion in the slider width direction. Further, a pawl hole 11*c* which penetrates from the upper surface of the upper blade 11 to the element guide path 15 is formed in a rear end portion of the accommodating groove 11*d*. Further, a front end portion of the accommodating groove 11*d* is provided with a recess 11*g* into which a hook portion 41 mentioned below of the leaf spring member 40 is inserted.

The cover body 20 in the present first embodiment has an upper surface portion, a front wall portion, a rear wall portion and right and left side wall portions, and is formed as a rectangular shape in a top elevational view. A distance between the inner surfaces of the right and left side wall portions in the cover body 20 is set to be the same size of a width between the outer side surfaces of the first and second tab attachment posts 16 and 17 in the slider body 10, or be larger than the width. Further, a distance between the outer surfaces of the right and left side wall portions in the cover body 20 is set to be smaller than a distance between arm portions mentioned below of the tab.

A dimension from an outer surface of a front wall portion in the cover body 20 to an outer surface of a rear wall portion (that is, a dimension in a length direction of the cover body 20) is set to be the same size as the size in the length direction in the upper blade 11. Further, a dimension in a height direction in the cover body 20 is set to such a dimension that the inner surface of the upper surface portion of the cover body 20 does not interfere with the forward and rearward fixing posts 11*a* and 11*b* of the slider body 10 or the first and second tab attachment posts 16 and 17 after being caulked, at a time of laying the cover body 20 over the upper blade 11.

Further, an insertion hole portion 21 which inserts the attachment shaft portion 33 of the tab 30 is formed in right and left side wall portions of the cover body 20, and a protruding portion 22 which is fitted into the fitting concave portion 11*h* provided in the upper blade 11 is provided in a suspended manner in a lower end of a rear wall portion of the cover body 20. In the present first embodiment, since the attachment shaft portion 33 of the tab 30 is retained rotatably at the predetermined position by the first and second tab attachment posts 16 and 17 which are arranged in the slider body 10, the attachment shaft portion 33 itself does not move in the back and forth direction and the up and down direction. In accordance with this, the insertion hole portion 21 formed in the cover body 20 can be formed small as long as the insertion hole portion 21 has such a size that can insert the attachment shaft portion 33 of the tab 30.

The tab 30 in the present first embodiment has a tab main body 31 which comes to a grip portion, right and left arm portions 32 which are extended from the tab main body 31, and the attachment shaft portion 33 which connects apical portions of the right and left arm portions 32. A distance between the right and left arm portions 32 in the tab 30 (a distance between inner side surfaces of the right and left arm portions 32) is set to be larger than the distance between the outer surfaces of the right and left side wall portions in the cover body 20, as mentioned above.

A projection portion 33*a* protruding toward the tab main body 31 side is arranged in a center portion in a width direction of the attachment shaft portion 33, and a protruding direction of the projection portion 33*a* is orthogonal to an axial direction of the attachment shaft portion 33 (the width direction of the tab 30).

The leaf spring member 40 in the present first embodiment is arranged in one end portion of the leaf spring member 40, and has a hook portion 41 which can be inserted to the recess 11*g* of the upper blade 11, a locking pawl 42 which is arranged in another end portion of the leaf spring member 40, and a cover portion 43 which is arranged between the hook portion 41 and the locking pawl 42 and has an inverted U-shaped vertical cross section.

In the case that the leaf spring member 40 is accommodated in the accommodating groove 11*d* of the slider body 10, the hook portion 41 of the leaf spring member 40 is accommodated in the recess 11*g* of the slider body 10, and the locking pawl 42 of the leaf spring member 40 is retained in a state in which it moves into the element guide path 15 via the pawl hole 11*c* of the slider body 10.

Next, a description will be given of a procedure of assembling the slider 1 in accordance with the present first embodiment having the constructing parts as mentioned above.

First of all, the attachment shaft portion 33 of the tab 30 is attached to the first and second tab attachment posts 16 and 17 in the left and right sides of the slider body 10. Specifically describing, the attachment shaft portion 33 of the tab 30 is inserted between the front and rear post portions 16*a*, 16*b*, 17*a* and 17*b* of the first and second tab attachment posts 16 and 17, and the upper end portions of the front and rear post portions 16*a*, 16*b*, 17*a* and 17*b* are thereafter pressed in such a direction that they come close to each other so as to be caulked. In accordance with this, as shown in FIG. 2, the attachment shaft portion 33 of the tab 30 is retained rotatably at the predetermined position by the first and second tab attachment posts 16 and 17. In this case, a small space portion may be formed between the upper end portions of the caulked front and rear post portions 16*a*, 16*b*, 17*a* and 17*b*.

Subsequently, the leaf spring member 40 is accommodated in the accommodating groove 11*d* from an upper side of the slider body 10 in a state in which the attachment shaft portion 33 tilts the tab 30 retained in the first and second tab attachment posts 16 and 17 to the rear port side. At this time, the leaf spring member 40 is inserted into the accommodating groove 11*d* from the above so as to be accommodated, in such a manner that the cover portion 43 of the leaf spring member 40 overstrides the center portion of the attachment shaft portion 33 including the projection portion 33*a* of the tab 30.

Since the leaf spring member 40 is accommodated in the accommodating groove 11*d* as mentioned above, the locking pawl 42 of the leaf spring member 40 goes into the element guide path 15 via the pawl hole 11*c* of the slider body 10. Further recess 41 of the leaf spring member 40 is accommodated in the recess 11*g* of the slider body 10.

One end portion of the leaf spring member 40 is fixed to the upper blade 11 by carrying out the caulking process in such a manner as to bend the right and left caulking portions 11*e* arranged in the front end portion of the upper blade 11 inward, after accommodating the leaf spring member 40 in the accommodating groove 11*d*.

Next, the cover body 20 is laid over the upper blade 11 of the slider body 10 to which the leaf spring member 40 is fixed. At this time, the cover body 20 is laid over the upper blade 11 in such a manner as to accommodate the right and left forward fixing posts 11*a* and the rearward fixing post 11*b* arranged in the upper blade 11 within the cover body 20, and the inner wall surface of the cover body 20 is brought into contact with the right and left forward fixing posts 11*a* and the rearward fixing post 11*b*. Further, the protruding portion 22 provided in the rear wall portion of the cover body 20 is fitted into the fitting concave portion 11*h* provided in the upper blade 11. In accordance with this, it is possible to mount the cover body 20 to the upper surface of the upper blade 11 while positioning the cover body 20.

After the cover body 20 is mounted to the upper blade 11, the portion of the cover body 20 corresponding to the fitting and attaching hole portion 11*f* formed in the forward fixing posts 11*a* and the rearward fixing post 11*b* is locally pressed from the outer side so as to be depressed into an inner portion. In accordance with this, since a convex portion is formed in the inner wall surface of the cover body 20, and the convex portion is fitted and attached to the fitting and attaching hole portion 11*f* formed in the forward fixing posts 11*a* and the rearward fixing post 11*b*, the cover body 20 is caulked and fixed by the right and left forward fixing posts 11*a* and the rearward fixing post 11*b*, and the slider 1 in accordance with the present first embodiment is assembled.

In the slider 1 of the present first embodiment which is assembled as mentioned above, for example, in a state in which the tab 30 is tilted to the rear port side or the shoulder port side, the locking pawl 42 arranged in the leaf spring member 40 goes into the element guide path 15 via the pawl hole 11*c* of the slider body 10. In accordance with this, the slider 1 can go on a stop mechanism of retaining the slider 1 at a position at which the slider 1 is stopped with respect to the element row of the slide fastener, in the case that it is used in the slide fastener.

On the other hand, in the case that the tab 30 is rotated, for example, the tab 30 is raised up in a direction which is orthogonal to the upper blade 11 of the slider body 10, the projection portion 33*a* arranged in the attachment shaft portion 33 of the tab 30 pushes upward the cover portion of the leaf spring member 40 against an energizing force of the leaf spring member 40. In accordance with this, since the locking pawl 42 moves away from the element guide path 15 of the slider body 10, and the stop mechanism of the slider 1 is released, it is possible to freely slide the slider 1 along the element row.

In this case, since the leaf spring member 40 elastically restores, and the locking pawl 42 of the leaf spring member 40 goes into the element guide path 15 of the slider 1, by again tilting the tab 30 to the rear port side or the shoulder port side, after releasing the stop mechanism of the slider 1, it is possible to go on the stop mechanism of the slider 1.

Further, in the slider 1 in accordance with the present first embodiment, the cover body 20 covers the first tab attachment post 16, the second tab attachment post 17, the forward fixing post 11*a*, the rearward fixing post 11*b*, the accommodating groove 11*d* and the caulking portion 11*e* which are arranged in the upper blade 11, and the attachment shaft portion 33 and the projection portion 33*a* of the tab 30 so as to be fixed to the upper blade 11.

In accordance with this, since a projection material such as the first and second tab attachment posts 16, 17 or the like, and an irregularity by the accommodating groove 11*d* are concealed, it is possible to smoothen the upper surface side of the slider 1. Accordingly, a touch feeling of the upper surface side of the slider 1 is improved, and an outer appearance is improved. It is possible to obtain a slide fastener which is excellent in quality by using the slider 1.

Further, the stop mechanism of the slider 1 which is constructed by the projection portion 33*a* of the tab 30 and the leaf spring member 40 is covered by the cover body 20 so as to be protected. In accordance with this, even if the slider 1 experiences a shock from the outer portion, it is possible to stably protect the stop mechanism from the shock or the like, and it is possible to effectively prevent the stop mechanism of the slider 1 from breaking down.

In addition, in the slider 1 in accordance with the present first embodiment, the stop mechanism of the slider 1 is constructed by the projection portion 33*a* arranged in the tab 30, the leaf spring member 40, the pawl hole 11*c* provided in the upper blade 11 and the like, however, the invention can be applied to a slider which is not provided with the stop mechanism, as long as the cover body is fixed to the upper blade in such a manner as to cover the first and second tab attachment posts.

Second Embodiment

Figure 3:
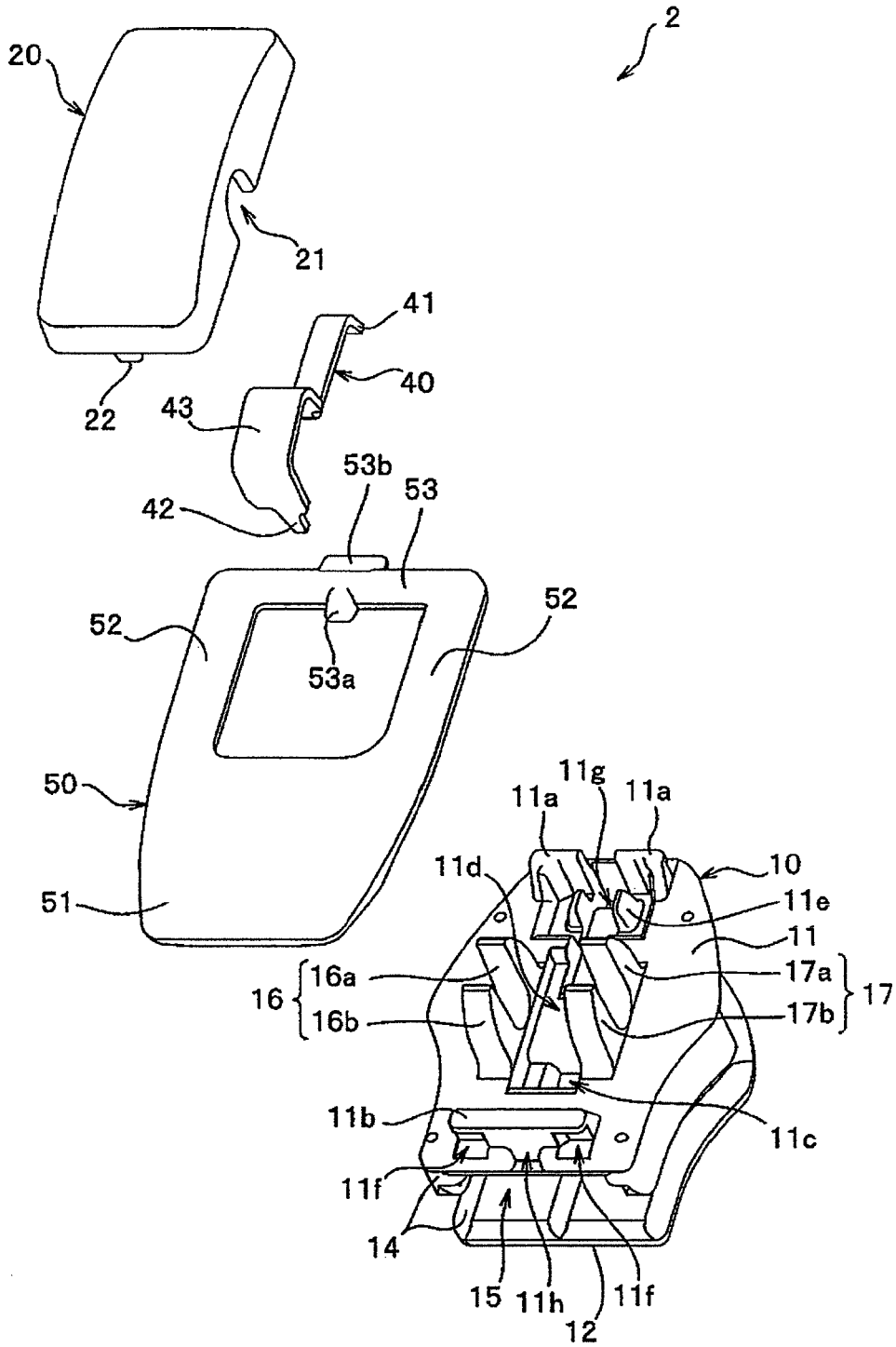
FIG. 3 is an exploded perspective view of a slider in accordance with a second embodiment of the invention.
Figure 4:
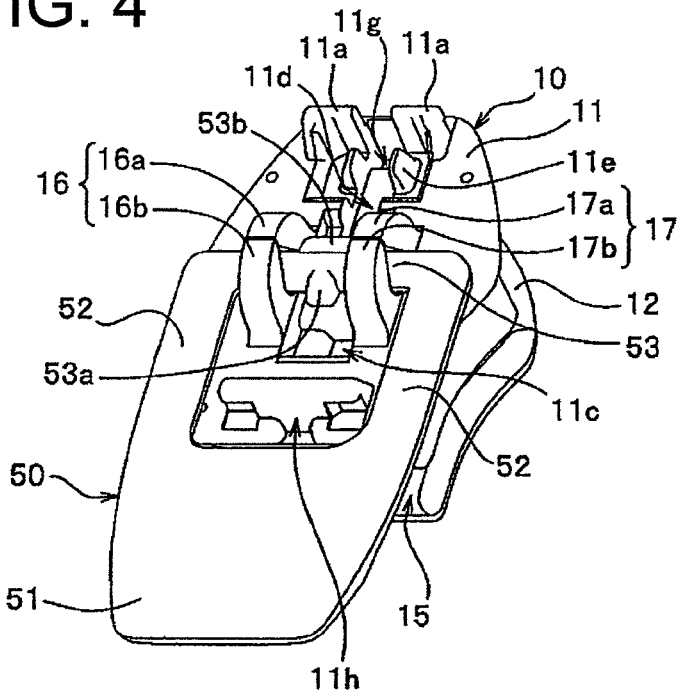
FIG. 4 is a perspective view showing a state before a leaf spring member and a cover body are installed in the slider.
Figure 5:
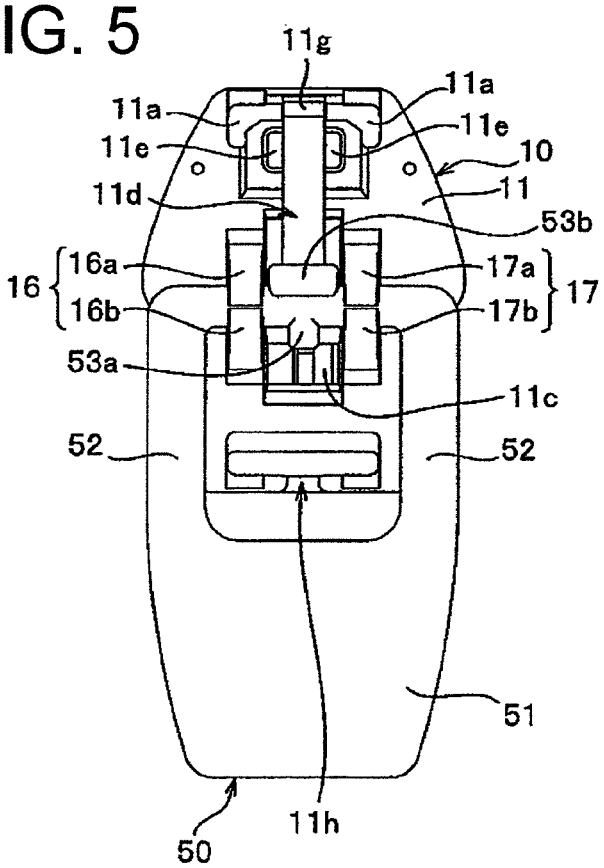
FIG. 5 is a top elevational view showing the state before the leaf spring member and the cover body are installed in the slider.
Figure 6:
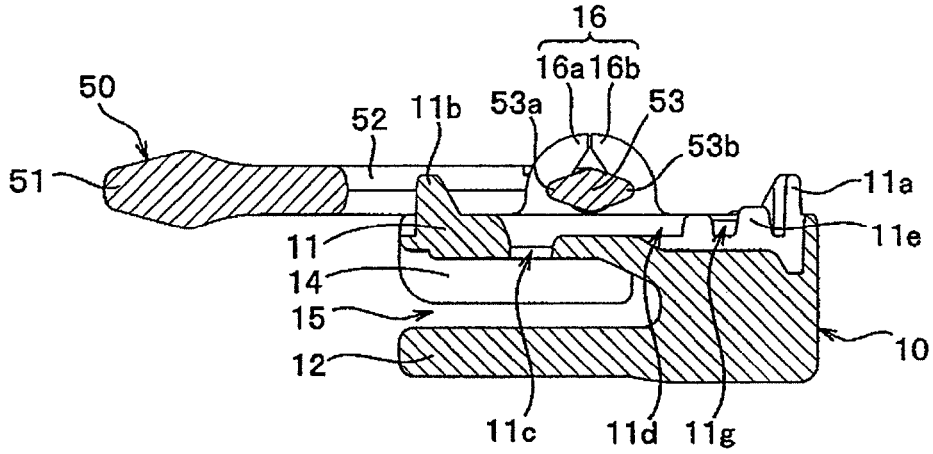
FIG. 6 is a cross sectional view showing the state before the leaf spring member and the cover body are installed in the slider.

FIG. 3 is an exploded perspective view of a slider in accordance with a second embodiment. Further, FIG. 4, FIG. 5 and FIG. 6 are respectively a perspective view, a top elevational view and a cross sectional view showing a state in which a leaf spring member and a cover body of the slider are installed.

A slider 2 for a slide fastener in accordance with the present second embodiment employs a tab 50 in which a movement control portion 53*b* is arranged in an attachment shaft portion 53, in place of the tab 30 in the slider 1 in accordance with the first embodiment mentioned above, and the other structures except the tab 50 are substantially the same as the slider 1 of the first embodiment mentioned above. Accordingly, in the slider 2 in accordance with the present second embodiment, the parts and members having the same structures as the slider 1 of the first embodiment mentioned above are indicated by using the same reference numerals, whereby a description of these parts and members will be omitted.

The slider 2 for the slide fastener in accordance with the present second embodiment has the slider body 10, the cover body 20 which is fixed to the slider body 10, the tab 50 which is rotatably retained in the slider body 10, and the leaf spring member 40 which is provided in its one end portion with the locking pawl 42.

The tab 50 in the present second embodiment has a tab main body 51 which comes to a grip portion, right and left arm portions 52 which are extended from the tab main body 51, and an attachment shaft portion 53 which connects apical portions of the right and left arm portions 52. A distance between the right and left arm portions 52 in the tab 50 (a distance between inner side surfaces of the right and left arm portions 52) is set to be larger than the distance between the outer surfaces of the right and left side wall portions in the cover body 20.

Further, in a center portion in an axial direction in the attachment shaft portion 53, there are arranged the projection portion 53*a* which protrudes toward the tab main body 51 side, and a movement control portion 53*b* which protrudes in an opposite direction to the projection portion 53*a*, and a protruding direction of the projection portion 53*a* and a protruding direction of the movement control portion 53*b* are orthogonal with respect to an axial direction of the attachment shaft portion 53.

The movement control portion 53*b* is arranged in such a manner as to be positioned between the first and second tab attachment posts 16 and 17 at a time when the attachment shaft portion 53 of the tab 50 is retained in the first and second tab attachment posts 16 and 17.

In this case, a dimension of the movement control portion 53*b* in the axial direction of the attachment shaft portion 53 is set to be equal to or more than 80% of the distance between the inner surfaces of the first and second tab attachment posts 16 and 17, preferably equal to or more than 85%. Since the dimension in a width direction of the movement control portion 53*b* is set as mentioned above, the movement control portion 53*b* is inserted between the first and second tab attachment posts 16 and 17 at a time when the attachment shaft portion 53 of the tab 50 is retained in the first and second tab attachment posts 16 and 17, whereby it is possible to carry out a positioning (an alignment) of the tab 50 with respect to the first and second tab attachment posts 16 and 17.

Further, since the movement control portion 53*b* controls a motion in the width direction of the tab 50 (the axial direction of the attachment shaft portion 53) between the first and second tab attachment posts 16 and 17, it is possible to secure a gap which can accommodate the right and left side wall portions of the cover body 40, between the outer side surface of the first tab attachment post 16 and the arm portion 52 of the tab 50, and between the outer side surface of the second tab attachment post 17 and the arm portion 52 of the tab 50.

Further, in the present second embodiment, a dimension of the movement control portion 53 in the axial direction of the attachment shaft portion 53 is set to be smaller than the distance between the inner surfaces of the first and second tab attachment posts 16 and 17, preferably equal to or less than 95% of the distance between the inner surfaces of the first and second tab attachment posts 16 and 17. In accordance with this, it is possible to prevent a matter that the movement control portion 53*b* of the tab 50 can not be inserted between the first and second tab attachment posts 16 and 17, at a time of inserting the attachment shaft portion 53 of the tab 50 to the first and second tab attachment posts 16 and 17 so as to be retained.

In this case, the movement control portion 53*b* of the present second embodiment protrudes to the opposite direction to the protruding direction of the projection portion 53*a* as mentioned above, however, in the invention, the protruding direction of the movement control portion 53*b* can be optionally set, as long as the movement control portion 53*b* is arranged so as to be orthogonal to the axial direction of the attachment shaft portion 53.

In this case, in the invention, it is preferable that the movement control portion 53*b* is arranged in such a manner that an angle between the protruding direction of the movement control portion 53*b* and the protruding direction of the projection portion 53*a* becomes larger than 90 degree.

For example, in the first and second tab attachment posts 16 and 17 which are caulked so as to retain the attachment shaft portion 53 of the tab 50, the small space portion may be formed between the upper end portions of the front and rear post portions 16*a*, 16*b*, 17*a* and 17*b*, as described in the first embodiment mentioned above.

In this case, if the space portion formed in the first and second tab attachment posts 16 and 17 has such a size that the movement control portion 53*b* of the tab 50 can enter into, there can be thought that the tab 50 moves in a tape width direction at a time when a position of the space portion mentioned above formed in the first and second tab attachment posts 16 and 17 and the position of the movement control portion 53*b* of the tab 50 overlap in a side view of the slider 2, for example, on the basis of an operation of the tab 50, and the movement control portion 53*b* of the tab 50 enters into the space portion mentioned above. If the movement control portion 53*b* of the tab 50 enters into the space portion mentioned above, the movement control portion 53*b* catches on the first or second tab attachment post 16 or 17, and there is a risk that such a problem that the tab 50 can not rotate is generated.

However, in the case that the movement control portion 53*b* is arranged in such a manner that the angle between the protruding direction of the movement control portion 53*b* and the protruding direction of the projection portion 53*a* becomes larger than 90 degree as the present second embodiment (particularly, in the case that the angle between the protruding direction of the movement control portion 53*b* and the protruding direction of the projection portion 53*a* comes to 180 degree), the movement control portion 53 of the tab 50 does not overlap the position of the space portion mentioned above formed in the first and second tab attachment posts 16 and 17 in the side view of the slider 2, within the rotatable range of tab 50 which is retained in the first and second tab attachment posts 16 and 17. Accordingly, it is possible to prevent the tab 50 from becoming non-rotatable.

In this case, in the present second embodiment, since the movement control portion 53*b* is arranged in the attachment shaft portion 53 of the tab 50, it is desirable that a concave portion which makes a groove depth deep and is not illustrated is provided in the accommodating groove 11*d* of the slider body 10, in such a manner as to prevent the movement control portion 53*b* from interfering with the slider body 10 at a time of the rotating motion of the tab 50.

Next, a description will be given of a procedure for assembling the slider 2 in accordance with the present second embodiment.

First of all, the attachment shaft portion 33 of the tab 30 is attached to the first and second tab attachment posts 16 and 17 in the left and right of the slider body 10. Specifically describing, the attachment shaft portion 33 of the tab 30 is inserted between the front and rear post portions 16*a*, 16*b*, 17*a* and 17*b* of the first and second tab attachment posts 16 and 17. At this time, in the tab 50 in accordance with the present second embodiment, since the movement control portion 53*b* is arranged in the attachment shaft portion 53 as mentioned above, it is possible to stably carry out the positioning of the tab 50 in the slider width direction with respect to the first and second tab attachment posts 16 and 17, by inserting the movement control portion 53*b* between the first and second tab attachment posts 16 and 17.

Subsequently, the upper end portions of the front and rear post portions 16*a*, 16*b*, 17*a* and 17*b* of the first and second tab attachment posts 16 and 17 are pressed in such a direction that they come close to each other so as to be caulked. In accordance with this, as shown in FIG. 4 to FIG. 6, the attachment shaft portion 53 of the tab 50 is rotatably retained by the first and second tab attachment posts 16 and 17 in the left and right sides.

Further, since the attachment shaft portion 53 of the tab 50 is retained by the first and second tab attachment posts 16 and 17 as mentioned above, whereby the movement control portion 53*b* controls the movement in the slider width direction of the tab 50 (the axial direction of the attachment shaft portion 53) between the first and second tab attachment posts 16 and 17, the gap which can accommodate the right and left side wall portions of the cover body 40 can be stably secured between the outer side surface of the first tab attachment post 16 and the arm portion 52 of the tab 50, and between the outer side surface of the second tab attachment post 17 and the arm portion 52 of the tab 50.

Next, one end portion of the leaf spring member 40 is fixed to the upper blade 11, by accommodating the leaf spring member 40 in the accommodating groove 11*d* from the above of the slider body 10, in a state in which the tab 50 is tilted to the rear port side, and carrying out the caulking process in such a manner as to inflect the right and left caulking portions 11*e* arranged in the front end portion of the upper blade 11 toward the inner side.

After the leaf spring member 40 is fixed to the slider body 10, the cover body 20 is laid over the upper blade 11 of the slider body 10. At this time, the cover body 20 is laid over the upper blade 11 in such a manner as to accommodate the forward fixing post 11*a* and the rearward fixing post 11*b* in the left and right which are arranged in the upper blade 11 into the cover body 20, and the inner surfaces of the front wall portion and the rear wall portion of the cover body 20 are brought into contact with the forward fixing post 11*a* and the rearward fixing post 11*b* in the left and right sides. Further, the protruding portion 22 provided in the rear wall portion of the cover body 20 is fitted into the fitting concave portion 11*h* provided in the upper blade 11. In accordance with this, it is possible to mount the cover body 20 on the upper surface of the upper blade 11 while positioning the cover body 20.

Particularly, in the present second embodiment, since the movement in the slider width direction of the tab 50 is controlled by the movement control portion 53*b*, a predetermined gap is formed between the outer side surface of the first tab attachment post 16 and the arm portion 52 of the tab 50, and between the outer side surface of the second tab attachment post 17 and the arm portion 52 of the tab 50. In accordance with this, the arm portion 52 of the tab 50 and the cover body 20 do not interfere at a time of laying the cover body 20 over the upper blade 11, and it is possible to smoothly and securely mount the cover body 20 to the upper surface of the upper blade 11.

Further, after the cover body 20 is mounted to the upper blade 11, the portion of the cover body 20 corresponding to the fitting and attaching hole portion 11*f* formed in the forward fixing post 11*a* and the rearward fixing post 11*b* is depressed to the inner portion by being locally pressed from the outer side. In accordance with this, the cover body 20 is caulked and fixed to the right and left forward fixing posts 11*a* and the rearward fixing post 11*b*, and the slider 1 in accordance with the present second embodiment is assembled.

The slider 2 in accordance with the present second embodiment assembled as mentioned above can go on the stop mechanism in a state in which the tab 50 is tilted to the rear port side or the shoulder port side, in the same manner as the first embodiment mentioned above. On the other hand, since the stop mechanism of the slider 2 is released at a time of raising the tab 50 in a direction which is orthogonal to the upper blade 11 of the slider body 10, it is possible to freely slide the slider 2 along the element row of the slide fastener.

Further, in the slider 2 in accordance with the present second embodiment, since the first and second tab attachment posts 16 and 17 in the upper blade 11 and the accommodating groove 11*d* are concealed by the cover body 20, a touch feeling of the slider 2 is improved, and an outer appearance is improved, so that it is possible to obtain a slider fastener which is excellent in quality by using the slider 2. Further, since the stop mechanism of the slider 2 is covered by the cover body 20 so as to be protected, it is possible to stably protect the stop mechanism from the shock or the like even if the slider 2 experiences the shock or the like from the outer portion, and it is possible to effectively prevent a trouble of the stop mechanism.

Further, in the present second embodiment, the description is given of the case that the tab 50 has one movement control portion 53*b*, and the movement control portion 53*b* is arranged in the center portion in the axial direction in the attachment shaft portion 53 in such a manner as to be held between the first and second tab attachment posts 16 and 17 of the slider body 10.

However, the mode of the movement control portion in the invention is not limited to this, but the mode of the movement control portion can be changed as long as the movement control portion can carry out the positioning of the tab at a time of attaching the tab to the first and second tab attachment posts, and can control the movement in the width direction of the tab which is retained in the first and second tab attachment posts.

For example, two movement control portions may be arranged in the center portion in the axial direction in the attachment shaft portion of the tab, in such a manner as to be held between the first and second tab attachment posts 16 and 17 of the slider body 10.

Figure 7:
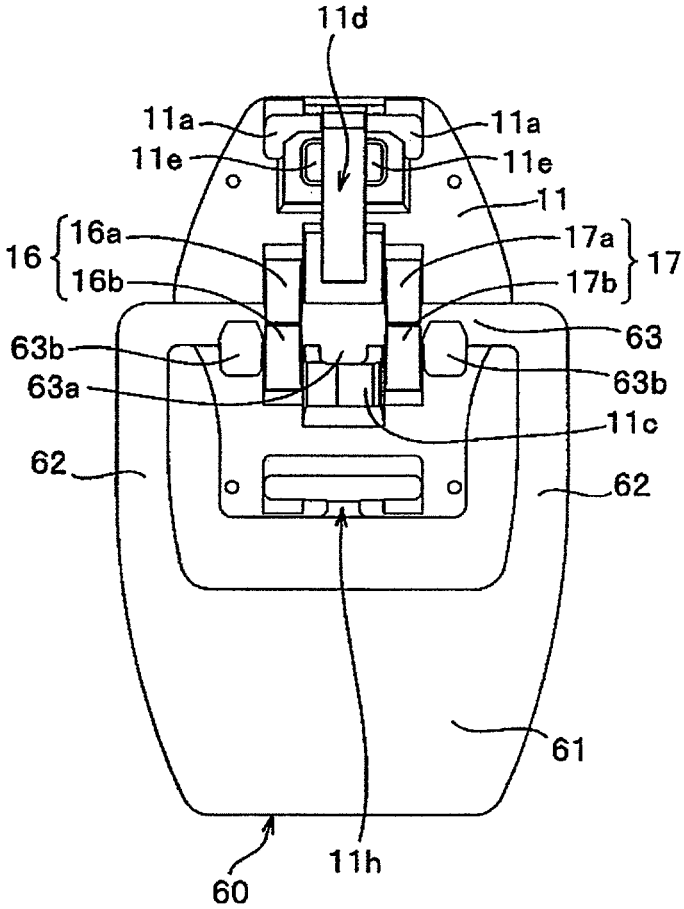
FIG. 7 is a top elevational view showing a state before a leaf spring member and a cover body are installed in a slider in accordance with a modified embodiment of the second embodiment.

Further, as a modified embodiment of the second embodiment is shown in FIG. 7, two movement control portions may be arranged in an attachment shaft portion of a tab in such a manner as to be positioned in the outer side of the first and second tab attachment posts 16 and 17, at a time when the attachment shaft portion 63 of the tab 60 is retained in the first and second tab attachment posts 16 and 17.

Specifically describing the tab 60 in accordance with the modified embodiment, the tab 60 has a tab main body 61 which comes to a grip portion, right and left arm portions 62 which are extended from the tab main body 61, and an attachment shaft portion 63 which connects apical portions of the right and left arm portions 62. Further, a projection portion 63*a* protruding toward the tab main body 61 side is arranged in a center portion in an axial direction in the attachment shaft portion 63. Further, movement control portions 63*b* protruding in parallel to the arm portion 62 toward the tab main body 61 side are arranged one by one at a part of the attachment shaft portion 63 which is spaced at a predetermined distance right and left from the projection portion 63*a*.

In this case, the projection portion 63*a* and two movement control portions 63*b* are arranged in parallel. In accordance with this, a rotating motion range of the tab 60 is set at a time when the attachment shaft portion 63 of the tab 60 is retained to the first and second tab attachment posts 16 and 17 of the slider body 10. In other words, in the case that the tab 60 is tilted to the slider rear port side and in the case that the tab 60 is tilted to the slider shoulder port side, a position of the tab 60 at a time when the movement control portion 63*b* comes into contact with the upper blade 11 comes to a rotating motion limit position in the rear port side of the slider of the tab 60. In this case, the rotating motion of the tab 60 is not prevented by the movement control portion 63 if within the rotating motion range of the tab 60, and it is possible to freely rotate the tab 60.

Further, two movement control portions 63*b* are arranged in such a manner as to be positioned in the outer side of the first and second tab attachment posts 16 and 17 at a time when the attachment shaft portion 63 of the tab 60 is retained to the first and second tab attachment posts 16 and 17.

In this case, a distance between inner surfaces in two movement control portions 63*b* is set to be the same distance as the distance between the outer side surfaces of the first and second tab attachment posts 16 and 17, or be slightly larger than the distance between the outer side surfaces of the first and second tab attachment posts 16 and 17. Further, a distance between outer side surfaces in two movement control portions 63*b* is set to be smaller than the distance between the inner surfaces of the right and left side wall portions in the cover body 20.

Even in the tab 60 in accordance with the modified embodiment, in the same manner as the tab 50 in accordance with the second embodiment mentioned above, it is possible to stably carry out the positioning of the tab 50 with respect to the first and second tab attachment posts 16 and 17 by two movement control portions 63*b*, at a time when the attachment shaft portion 63 of the tab 60 is retained to the first and second tab attachment posts 16 and 17.

Further, when the attachment shaft portion 63 of the tab 60 is retained to the first and second tab attachment posts 16 and 17, two movement control portions 63*b* control the movement in the slider width direction of the tab 60 (the axial direction of the attachment shaft portion 63) between the first and second tab attachment posts 16 and 17. In accordance with this, it is possible to prevent the arm portion 62 of the tab 60 and the cover body 20 from interfering at a time of thereafter laying the cover body 20 over the upper blade 11, whereby it is possible to smoothly and securely mount the cover body 20 to the upper surface of the upper blade 11 so as to fix.

Further, as the other mode of the movement control portion in the invention, for example, the projection portion arranged in the attachment shaft portion of the tab may be enlarged in the width direction (the axial direction of the attachment shaft portion), and the projection portion may be utilized as the movement control portion.

Further, for example, a diameter of the attachment shaft portion of the tab may be made larger than the distance between the front and rear post portions in the first and second tab attachment posts, and only a diameter of the portion of the attachment shaft portion which is retained to the first and second tab attachment posts may be aligned with the distance between the front and rear post portions.

It is possible to stably carry out the positioning of the tab with respect to the first and second tab attachment posts, by structuring the movement control portion as mentioned above, and it is possible to control the movement in the width direction of the tab, at a time when the attachment shaft portion of the tab is retained to the first and second tab attachment posts.

Third Embodiment

Figure 8:
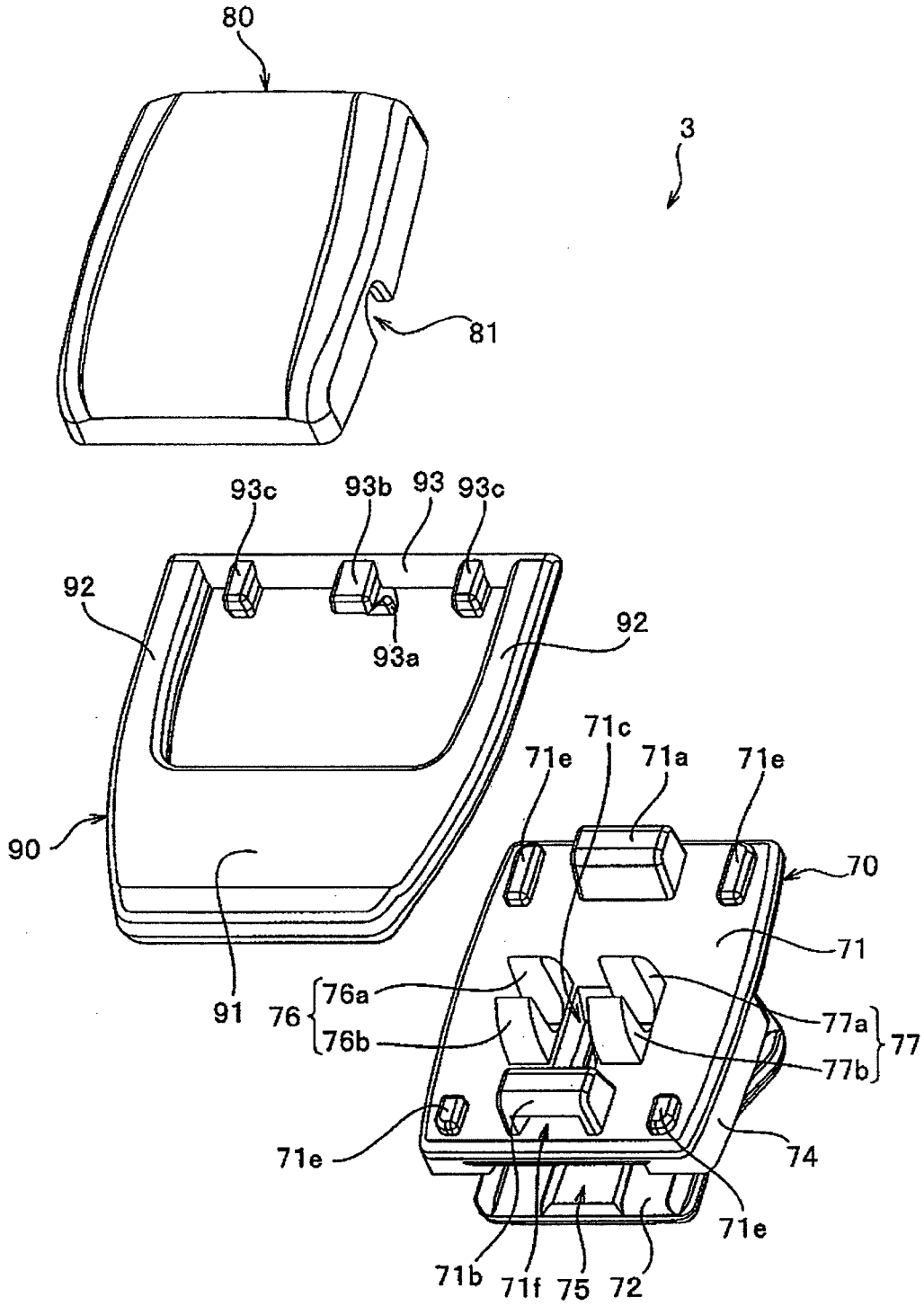
FIG. 8 is an exploded perspective view of a slider in accordance with a third embodiment of the invention.
Figure 9:
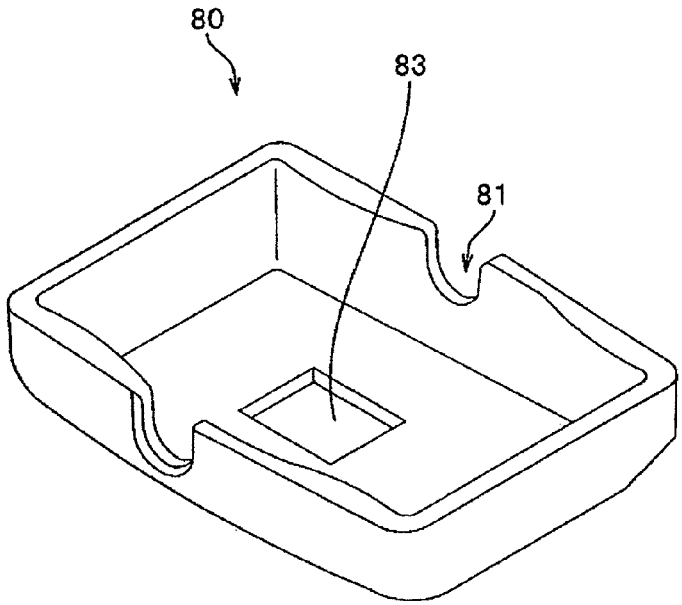
FIG. 9 is a perspective view of a cover body of the slider as seen from a back face side.

FIG. 8 is an exploded perspective view of a slider in accordance with a third embodiment. Further, FIG. 9 is a perspective view of a cover body of the slider as seen from a back face side.

A slider 3 for the slide fastener in accordance with the present third embodiment has a slider body 70, a cover body 80 which is fixed to the slider body 70, and a tab 90 which is rotatably retained to the slider body 70.

The slider body 70 in the slider 3 has an upper blade 71, a lower blade 72 which is arranged in parallel so as to be spaced from the upper blade 71, a guide column 73 which connects front end portions of the upper and lower blades 71 and 72, and flanges 74 which are arranged in right and left side edges of the upper and lower blades 71 and 72. Right and left shoulder ports formed while holding the guide column 73 between them are formed in a front end of the slider body 70, and a rear port is formed in a rear end of the slider body 70. Further, a Y-shaped element guide path 75 communicating the right and left shoulder ports and the rear port is formed between the upper and lower blades 71 and 72.

The upper blade 71 in the slider body 70 has a rectangular shape in a top elevational view. Further, an upper surface of the upper blade 71 has a forward fixing post 71*a* and a rearward fixing post 71*b* to which a cover body 80 is caulked and fixed, left and right first and second tab attachment posts 76 and 77 which rotatably retain an attachment shaft portion 93 of the tab 90, a pawl hole 71*c* which is arranged between the first and second tab attachment posts 76 and 77, and positioning convex portions 71*e* each of which is provided in a concave manner in the vicinity of each of four corner portions of the upper blade 71.

The forward and rearward fixing posts 71*a* and 71*b* are arranged in a front end portion and a rear end portion of the upper blade 71, and are provided in a rising manner in a center portion in a slider width direction. Further, in a front face portion of the forward fixing post 71*a* and a rear face portion of the rearward fixing post 71*b*, there is formed a fitting and attaching hole portion 71*f* for fitting and attaching a depressed portion of the cover body 80 by caulking (a convex portion in an inner wall surface side), at a time of caulking and fixing the cover body 80.

The first tab attachment post 76 in the left side and the second tab attachment post 77 in the right side are arranged while holding the pawl hole 71*c* between them, and respectively have front post portions 76*a* and 77*a* and rear post portions 76*b* and 77*b*. Further, the front post portions 76*a* and 77*a* and the rear post portions 76*b* and 77*b* are provided in a rising manner in such a manner that a cross sectional dimension in a back and forth direction is gradually reduced in accordance with an increase of the height, and a gap which can insert the attachment shaft portion 93 of the tab 90 is provided between the front post portions 76*a* and 77*a* and the rear post portions 76*b* and 77*b*.

The pawl hole 71*c* arranged between the first and second tab attachment posts 76 and 77 is formed so as to pass through the element guide path 75 from an upper surface of the upper blade 71.

Four positioning convex portions 71*e* arranged in the upper blade 71 are structured such as to come into contact with inner surfaces of front and rear wall portions of the cover body 80 and inner surface of right and left side-wall portions at a time when the cover body 80 is laid over the slider body 70 in such a manner as to cover the upper surface side of the upper blade 71, whereby it is possible to position the cover body 80 in a back and forth direction and a right and left direction.

The cover body 80 in the present third embodiment is formed in such a manner as to have a rectangular shape having the same dimension as the upper blade 71 at a time of viewing from the upper surface side. Further, a dimension in a height direction in the cover body 80 is set in such a manner that when the cover body 80 is laid over the upper blade 71, the inner surface of the upper surface portion in the cover body 80 does not interfere with the forward and rearward fixing posts 71*a* and 71*b* of the slider body 70 and the caulked first and second tab attachment posts 76 and 77.

In this case, a concave portion 83 is formed in the inner surface of the upper surface portion of the cover body 80, as shown in FIG. 9. The concave portion 83 is arranged so as to correspond to a position of a movement control portion 93*b* mentioned below arranged in the tab 90, at a time when the cover body 80 is laid over the upper blade 71. Since the concave portion 83 is formed, it is possible to prevent the movement control portion 93*b* of the tab 90 from interfering with the cover body 80, even if the tab 90 retained to the slider body 70 rotates.

Further, an insertion hole portion 81 which inserts the attachment shaft portion 93 of the tab 90 is formed in right and left side wall portions in the cover body 80. In the present third embodiment, since the attachment shaft portion 93 of the tab 90 is rotatably retained to the first and second tab attachment posts 76 and 77 in the left and right arranged in the slider body 70, in the same manner as the first embodiment mentioned above, it is possible to form the insertion hole portion 81 small.

The tab 90 in the present third embodiment has a tab main body 91 which comes to a grip portion, right and left arm portions 92 which are extended from the tab main body 91, and an attachment shaft portion 93 which connects apical portions of the right and left arm portions 92. Further, the attachment shaft portion 93 has a circular cross section, and in a center portion in an axial direction in the attachment shaft portion 93, there are arranged a locking pawl 93*a* which is provided so as to protrude in a direction which is orthogonal to the tab main body 91, and a movement control portion 93*b* which protrudes in parallel to the tab main body 91 and in parallel to the arm portion 92 from the attachment shaft portion 93 toward the tab main body 91.

Further, a rotating motion controlling projection 93*c* which is extended in parallel to the tab main body 91 and from the attachment shaft portion 93 toward the tab main body 91 is arranged in both right and left sides of the locking pawl 93*a* and the movement control portion 93*b*. In this case, a protruding direction of the locking pawl 93*a*, a protruding direction of the movement control portion 93*b*, and an extending direction of the rotating motion controlling projection 93*c* are orthogonal to an axial direction of the attachment shaft portion 93.

In the tab 90 in accordance with the present third embodiment, since the movement control portion 93*b* and the rotating motion controlling projection 93*c* are arranged in the attachment shaft portion 93 as mentioned above, a rotating motion range of the tab 90 is set. In other words, in the case that the tab 90 is tilted to the slider rear port side, a position of the tab 90 at a time when the rotating motion controlling projection 93*c* comes into contact with the upper blade 71 comes to a rotating motion limit position in a slider rear end side of the tab 90.

Further, in the case that the tab 90 is tilted to the slider shoulder port side, a position of the tab 90 at a time when the movement control portion 93*b* and the rotating motion controlling projection 93*c* come into contact with the upper blade 71 comes to a rotating motion limit position in a slider front end side of the tab 90. In this case, the rotating motion of the tab 90 is not prevented by the movement control portion 93*b* and the rotating motion controlling projection 93*c* within the rotating motion range of the tab 90, and it is possible to freely rotate the tab 90.

The movement control portion 93*b* in the present third embodiment is arranged in such a manner as to be positioned between the first and second tab attachment posts 76 and 77 at a time when the attachment shaft portion 93 of the tab 90 is retained to the first and second tab attachment posts 76 and 77.

Since the movement control portion 93*b* mentioned above is arranged in the attachment shaft portion 93, the movement control portion 93*b* is inserted between the first and second tab attaching posts 76 and 77 at a time when the attachment shaft portion 93 of the tab 90 is retained to the first and second tab attachment posts 76 and 77, whereby it is possible to carry out the positioning of the tab 90 with respect to the first and second tab attachment posts 76 and 77.

Further, since the movement control portion 93*b* is controlled the movement in the width direction of the tab 90 (the axial direction of the attachment shaft portion 93) between the first and second tab attachment posts 76 and 77, it is possible to prevent the arm portion 92 of the tab 90 and the cover body 80 from interfering at a time of thereafter laying the cover body 80 over the upper blade 71, and it is possible to smoothly mount the cover body 80 to the upper surface of the upper blade 71 so as to fix.

Further, in this case, since a distance between the inner surfaces in the right and left rotating motion controlling projections 93*c* is set to the same distance as the distance between the outer side surfaces of the first and second tab attachment posts 76 and 77, or to be slightly larger than the distance between the outer side surfaces of the first and second tab attachment posts 76 and 77, the right and left rotating motion controlling projections 93*c* can be utilized as the movement control portion.

In accordance with this, it is possible to more stably carry out the positioning of the tab 50 at a time of retaining the attachment shaft portion 93 of the tab 90 to the first and second tab attachment posts 76 and 77, and after the attachment shaft portion 63 of the tab 60 is retained, it is possible to more securely control the movement in the slider width direction of the tab 60.

Next, a description will be given of a procedure of assembling the slider 3 in accordance with the present third embodiment.

First of all, the attachment shaft portion 93 of the tab 90 is attached to the first and second tab attachment posts 76 and 77 in the left and right sides of the slider body 70. Specifically describing, the attachment shaft portion 93 of the tab 90 is inserted between the front and rear post portions 76*a*, 76*b*, 77*a* and 77*b* of the first and second tab attachment posts 76 and 77.

At this time, in the tab 90 in accordance with the present third embodiment, since the movement control portion 93*b* is arranged in the attachment shaft portion 93 as mentioned above, it is possible to stably carry out the positioning of the tab 50 in the slider width direction with respect to the first and second tab attachment posts 76 and 77, by inserting the movement control portion 93*b* between the first and second tab attachment posts 76 and 77.

Subsequently, the upper end portions of the front and rear post portions 76*a*, 76*b*, 77*a* and 77*b* of the first and second tab attachment posts 76 and 77 are pressed in a direction in which they come close to each other so as to be caulked. In accordance with this, the attachment shaft portion 93 of the tab 90 is rotatably retained to the first and second tab attachment posts 76 and 77 in the left and right sides. At this time, the attachment shaft portion 93 of the tab 90 is retained to the first and second tab attachment posts 76 and 77 in the portion between the locking pawl 93*a* and the movement control portion 93*b*, and the left and right rotating motion controlling projection 93*c*.

Further, since the attachment shaft portion 93 of the tab 90 is retained by the first and second tab attachment posts 76 and 77, the movement control portion 93*b* and the rotating motion controlling projection 93*c* can control the movement in the width direction of the tab 90 between the first and second tab attachment posts 76 and 77. Further, at this time, the locking pawl 93*a* of the tab 90 is inserted to the pawl hole 71*c* of the upper blade 71, or is arranged at a position capable of being inserted to the pawl hole 71*c*.

Next, the cover body 80 is laid over the upper blade 71 of the slider body 70 in a state in which the tab 90 is tilted to the rear port side. In the case that the tab 90 is retained to the tab attachment post 76, the right and left rotating motion controlling projections 93*c* arranged in the attachment shaft portion 93 come into contact with the upper blade 71, whereby a rotating motion is limited. In accordance with this, a state in which the rotating motion controlling projection 93*c* of the tab 90 comes into contact with the upper blade 71 comes to a state in which the tab 90 is tilted to the rear end side of the slider to the maximum (a state of a rotating motion limit position).

At this time, the cover body 80 is laid over the upper blade 71 in such a manner as to accommodate the forward and rearward fixing posts 71*a* and 71*b* and four positioning convex portions 71*e* which are arranged in the upper blade 71 within the cover body 80, and the front and rear wall portions and the right and left side wall portions of the cover body 20 are brought into contact with four positioning convex portions 71*e*. In accordance with this, it is possible to mount the cover body 80 to the upper surface of the upper blade 71 while positioning the cover body 80.

Particularly, in the present third embodiment, since the movement in the width direction of the tab 90 is controlled by the movement control portion 93*b* and the rotating motion controlling projection 93*c*, a predetermined gap is formed between the outer side surface of the first tab attachment post 76 and the arm portion 92 of the tab 90 (particularly between the outer side surface of the rotating motion controlling projection 93*c* in the left side and the arm portion 92 of the tab 90), and between the outer side surface of the second tab attachment post 77 and the arm portion 92 of the tab 90 (particularly between the outer side surface of the rotating motion controlling projection 93*c* in the right side and the arm portion 92 of the tab 90). In accordance with this, it is possible to prevent the arm portion 92 of the tab 90 and the cover body 80 from interfering at a time of laying the cover body 80 over the upper blade 71, and it is possible to smoothly and securely mount the cover body 80 to the upper surface of the upper blade 71.

After the cover body 80 is mounted to the upper blade 71, the portion of the cover body 80 which corresponds to the fitting and attaching hole portions 71*f* formed in the forward fixing post 71*a* and the rearward fixing post 71*b* is locally pressed from the outer side so as to be depressed to the inner portion. In accordance with this, the cover body 80 is caulked and fixed to the forward fixing post 71*a* and the rearward fixing post 71*b*, and the slider 3 in accordance with the present third embodiment can be assembled.

Figure 10:
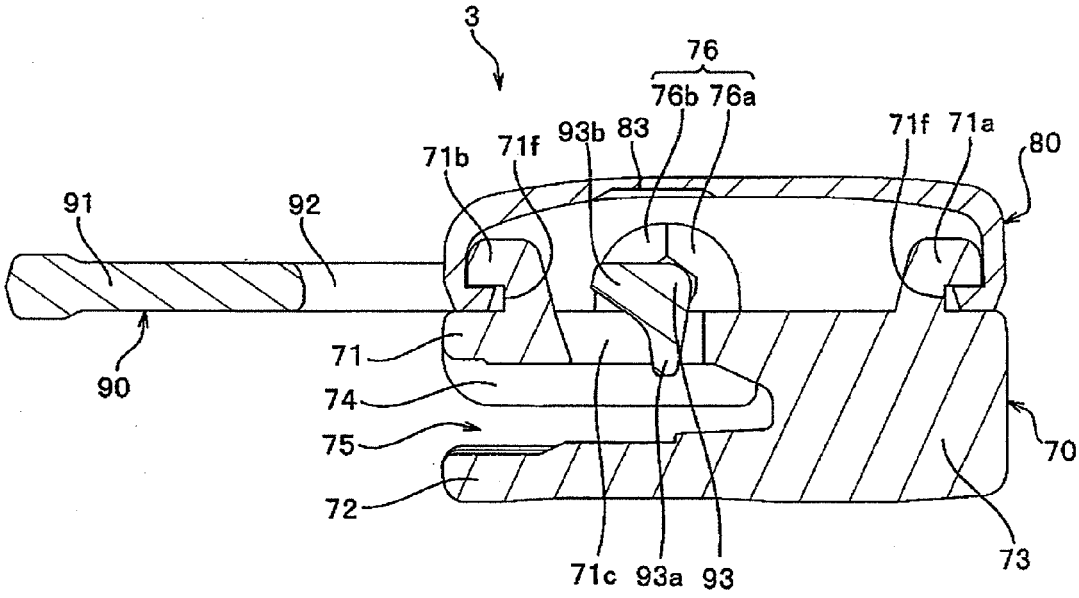
FIG. 10 is a cross sectional view showing a state in which a locking pawl of the slider goes into an element guide path.

In the slider 3 in accordance with the present third embodiment obtained as mentioned above, in the case of a state in which the tab 90 is tilted to the rear port side, for example, as shown in FIG. 10 (a state of rotating to the rotating motion limit position in the rear end side), the locking pawl 93*a* formed so as to protrude out of the attachment shaft portion 93 of the tab 90 goes into the element guide path 75 of the slider body 70. In accordance with this, the slider 3 can go on the stop mechanism.

Figure 11:
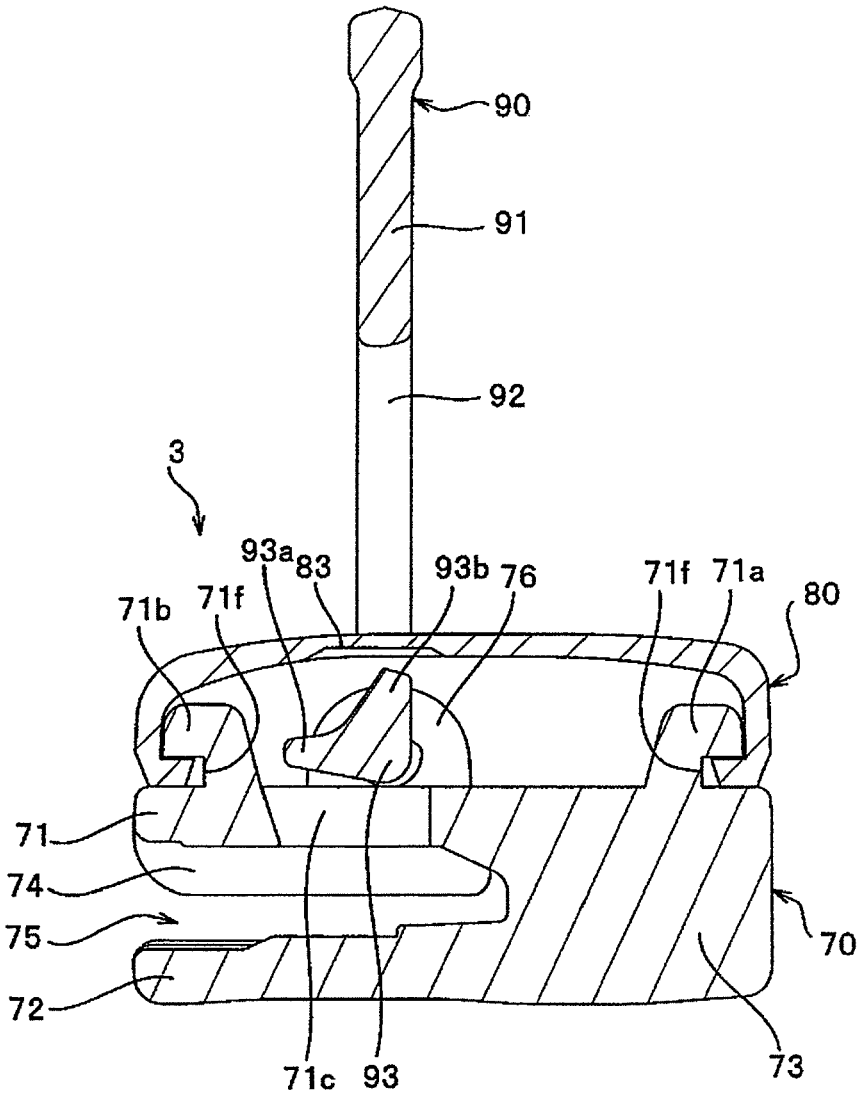
FIG. 11 is a cross sectional view showing a state in which the locking pawl of the slider goes out of the element guide path.

On the other hand, in the case that the tab 90 is rotated, and the tab 90 is raised in a direction which is orthogonal to the upper blade 71 of the slider body 70, for example, as shown in FIG. 11, the locking pawl 93*a* moves out of the element guide path 75 of the slider body 70 in accordance with the rotating motion of the tab 90. Accordingly, the stop mechanism of the slider 3 is released, and it is possible to freely slide the slider 3 along the element row of the slide fastener.

Further, in the slider 3 in accordance with the present third embodiment, since the cover body 80 has the rectangular shape having the same dimension as the upper blade 71 in the top elevational view as mentioned above, and the cover body 80 covers a whole of the upper surface side of the upper blade 71. In accordance with this, it is possible to smoothen the upper surface of the slider 3 in a wide range.

Further, each of the front and rear, right and left surfaces portions in the cover body 80 can be arranged on the same plane as each of the surface portions of the upper blade 71. In accordance with this, a step is not formed between the upper blade 71 and the cover body 80, in each of the front and rear, right and left surface portions in the slider 3, and it is possible to smoothen the side surface portions of the upper blade 71 and the cover body 80.

Accordingly, the slider 3 in accordance with the present third embodiment can obtain a good touch feeling, and has a good outer appearance. Further, even if the slider 3 is used in the products such as the clothes, the bags or the like, it is possible to prevent the slider 3 from catching on the other articles. Further, since the stop mechanism of the slider 3 is covered by the cover body 80 so as to be protected, it is possible to stably protect the stop mechanism from the shock or the like even if the slider 3 experiences the shock or the like from the outer portion, and it is possible to effectively prevent the trouble of the stop mechanism.

DESCRIPTION OF REFERENCE NUMERALS

1 Slider
2 Slider
3 Slider
10 Slider body
11 Upper blade
11*a* Forward fixing post
11*b* Rearward fixing post
11*c* Pawl hole
11*d* Accommodating groove
11*e* Caulking portion
11*f* Fitting and attaching hole portion
11*g* Recess
11*h* Fitting concave portion
12 Lower blade
14 Flange
15 Element guide path
16 First tab attachment post
16*a* Front post portion
16*b* Rear post portion
17 Second tab attachment post
17*a* Front post portion
17*b* Rear post portion
20 Cover body
21 Insertion hole portion
22 Protruding portion
30 Tab
31 Tab main body
32 Arm portion
33 Attachment shaft portion
33*a* Projection portion
40 Leaf spring member
41 Hook portion
42 Locking pawl
43 Cover portion
50 Tab
51 Tab main body
52 Arm portion
53 Attachment shaft portion
53*a* Projection portion
53*b* Movement control portion
60 Tab
61 Tab main body
62 Arm portion
63 Attachment shaft portion
63*a* Projection portion
63*b* Movement control portion
70 Slider body
71 Upper blade
71*a* Forward fixing post
71*b* Rearward fixing post
71*c* Pawl hole
71*e* Positioning convex portion
71*f* Fitting and attaching hole portion
72 Lower blade
73 Guide column
74 Flange
75 Element guide path
76 First tab attachment post
76*a* Front post portion
76*b* Rear post portion
77 Second tab attachment post
77*a* Front post portion
77*b* Rear post portion
80 Cover body
81 Insertion hole portion
83 Concave portion
90 Tab
91 Tab main body
92 Arm portion
93 Attachment shaft portion
93*a* Locking pawl
93*b* Movement control portion
93*c* Rotating motion controlling projection

The invention claimed is:

1. A slider for a slide fastener comprising a slider body in which upper and lower blades are connected by a guide column, and first and second tab attachment posts are provided in a rising manner in an upper surface of the upper blade, and a tab in which a tab main body and an attachment shaft portion are connected by a first arm portion and a second arm portion, wherein front and rear post portions of each of the first and second tab attachment posts are pressed towards each other and the attachment shaft portion of the tab is rotatably retained within the first and second tab attachment posts, and a cover body covering outer side surfaces, front surfaces, and rear surfaces of the first and second tab attachment posts is fixed to the upper blade, and the cover body has an upper surface portion, a front wall portion, a rear wall portion and right and left side wall portions, and the right side wall portion covers the outer side surface of the first tab attachment post and is accommodated between the outer side surface of the first tab attachment post and the first arm portion of the tab and the left side wall portion covers the outer side surface of the second tab attachment post and is accommodated between the outer side surface of the second tab attachment post and the second arm portion of the tab, and a movement control portion which controls a movement of the attachment shaft portion of the tab in an axial direction of the attachment shaft portion with respect to the first and second tab attachment posts, and which secures a first gap capable of accommodating the right side wall portion of the cover body between the outer side surface of the first tab attachment post and the first arm portion of the tab and a second gap capable of accommodating the left side wall portion of the cover body between the outer side surface of the second tab attachment post and the second arm portion of the tab.

2. The slider for a slide fastener according to claim 1, wherein a pawl hole is arranged between the first and second tab attachment posts of the upper blade, a stop mechanism is constructed by a locking pawl which is arranged so as to be movable into and out of an element guide path between the upper and lower blades, via the pawl hole on the basis of an operation of the tab, and the stop mechanism is covered by the cover body which is fixed to the upper blade.

3. The slider for a slide fastener according to claim 2, wherein the locking pawl is arranged in a leaf spring member which is installed to the slider body, and the attachment shaft portion of the tab has a projection portion which pushes up the leaf spring member on the basis of an operation of the tab so as to move the locking pawl out of the element guide path.

4. The slider for a slide fastener according to claim 1, wherein the movement control portion protrudes from the attachment shaft portion in a direction which is orthogonal to the axial direction of the attachment shaft portion.

5. The slider for a slide fastener according to claim 1, wherein the movement control portion is arranged between the first and second tab attachment posts.

6. The slider for a slide fastener according to claim 5, wherein a dimension of the movement control portion in the axial direction of the attachment shaft portion is set to be equal to or more than 80% of a distance between the first and second tab attachment posts.

7. The slider for a slide fastener according to claim 1, wherein a distance between inner surfaces of the right and left side wall portions of the cover body is at least as large as a width between the outer side surfaces of the first and second tab attachment posts.

8. The slider for a slide fastener according to claim 1, wherein a distance between the outer surfaces of the right and left side wall portions in the cover body is smaller than a distance between the right and left arm portions of the tab.

9. The slider for a slide fastener according to claim 7, wherein a distance between the outer surfaces of the right and left side wall portions in the cover body is smaller than a distance between the right and left arm portions of the tab.

* * * * *

UNITED STATES PATENT AND TRADEMARK OFFICE

CERTIFICATE OF CORRECTION

PATENT NO. : 8,966,720 B2
APPLICATION NO. : 13/502782
DATED : March 3, 2015
INVENTOR(S) : Yohei Miyazaki et al.

It is certified that error appears in the above-identified patent and that said Letters Patent is hereby corrected as shown below:

Title page, item (30), in column 1, in Foreign Application Priority Data, delete
"December 25, 2009 (JP) .....2009/071664" and insert
-- December 25, 2009 (WO) .....PCT/JP2009/071664 --, therefor.

In the Specification

In column 1, lines 4-5, delete "PCT/US2009/071664," and insert -- PCT/JP2009/071664, --, therefor.

Signed and Sealed this
Eleventh Day of August, 2015

Michelle K. Lee

Michelle K. Lee
*Director of the United States Patent and Trademark Office*